US009218770B2

(12) United States Patent
Fergason et al.

(10) Patent No.: US 9,218,770 B2
(45) Date of Patent: Dec. 22, 2015

(54) APPARATUS, METHOD AND SYSTEM TO ENHANCE LEGIBILITY OF IMAGES SHOWN ON A PASSIVE DISPLAY IN A BRIGHT ENVIRONMENT BY INCREASING OR MAINTAINING A RANGE OF GREY LEVELS AND DECREASING A NUMBER OF GREY LEVELS IN THAT RANGE

(75) Inventors: John D. Fergason, Cupertino, CA (US); James L. Fergason, Menlo Park, CA (US); Dora D. Fergason, legal representative, Menlo Park, CA (US)

(73) Assignee: Fergason Licensing LLC, Portola Valley, CA (US)

( * ) Notice: Subject to any disclaimer, the term of this patent is extended or adjusted under 35 U.S.C. 154(b) by 1079 days.

(21) Appl. No.: 13/150,433

(22) Filed: Jun. 1, 2011

(65) Prior Publication Data

US 2011/0310131 A1 Dec. 22, 2011

Related U.S. Application Data

(60) Provisional application No. 61/356,837, filed on Jun. 21, 2010.

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.
CPC ..... *G09G 3/3406* (2013.01); *G09G 2320/0646* (2013.01); *G09G 2360/144* (2013.01)

(58) Field of Classification Search
CPC ..... G09G 3/3406
See application file for complete search history.

(56) References Cited

U.S. PATENT DOCUMENTS

| | | | | |
|---|---|---|---|---|
| 5,717,422 | A * | 2/1998 | Fergason | 345/102 |
| 2002/0011979 | A1 * | 1/2002 | Nitta et al. | 345/89 |
| 2003/0095397 | A1 * | 5/2003 | McGowan | 362/27 |
| 2008/0049005 | A1 * | 2/2008 | Okita et al. | 345/207 |
| 2008/0062208 | A1 * | 3/2008 | Tada et al. | 345/690 |
| 2008/0259012 | A1 * | 10/2008 | Fergason | 345/89 |
| 2011/0241978 | A1 * | 10/2011 | Fergason | 345/88 |

FOREIGN PATENT DOCUMENTS

JP 2009053534 A * 3/2009

* cited by examiner

*Primary Examiner* — Joseph Feild
*Assistant Examiner* — Karin Kiyabu
(74) *Attorney, Agent, or Firm* — Vedder Price P.C.

(57) ABSTRACT

A display system and method for improving legibility of images viewed on a passive display in a bright environment, including apparatus and method for increasing or maintaining the range of grey levels for the image as viewed on the display and decreasing the number of grey levels used in that range.

12 Claims, 8 Drawing Sheets

FIGURE #1: "NORMAL" IMAGE IN DIM AMBIENT WITH MEDIUM BACKLIGHT
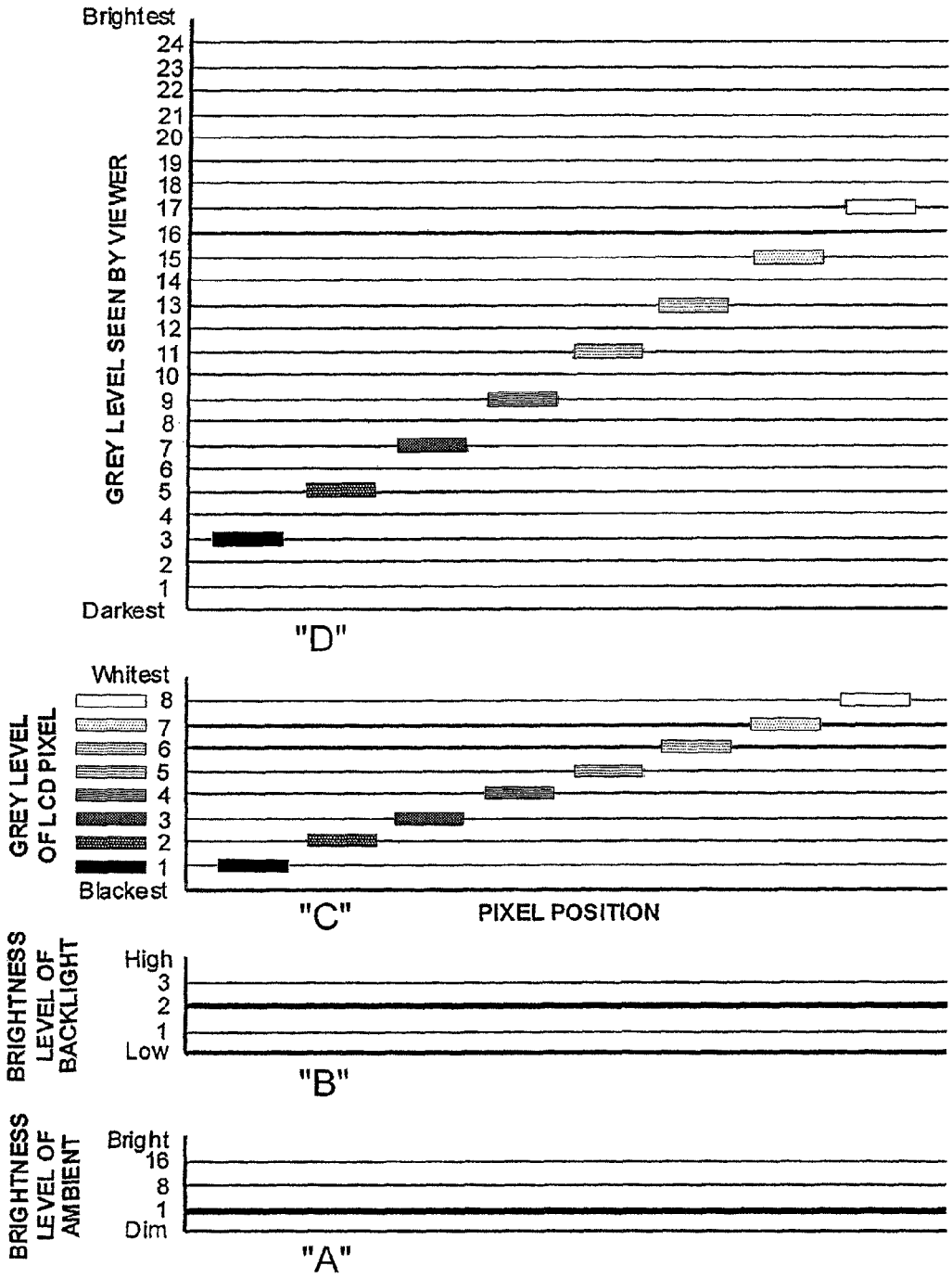

FIGURE #2: "NORMAL" IMAGE IN INTERMEDIATE AMBIENT WITH MEDIUM BACKLIGHT
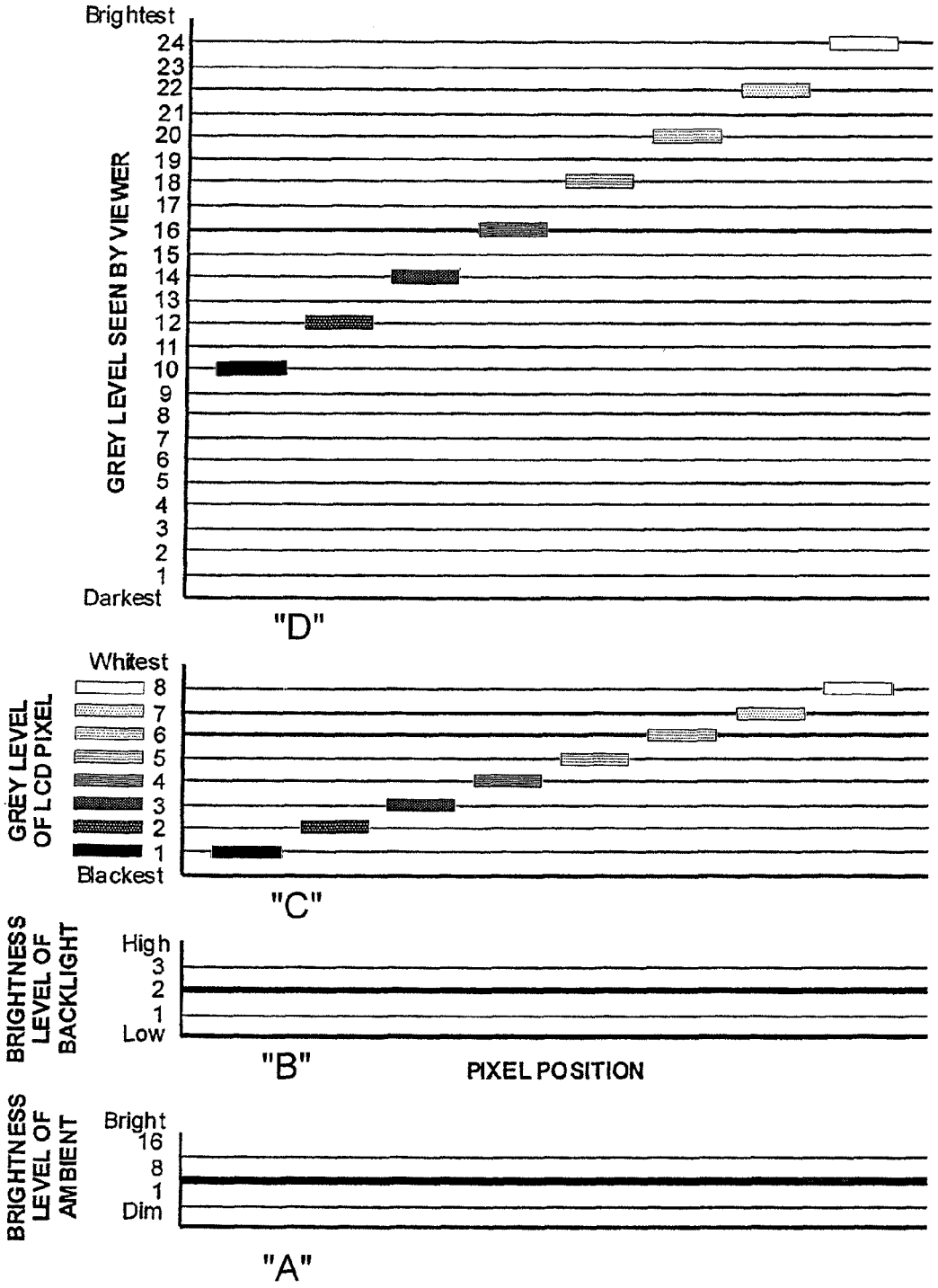

FIGURE #3: "NORMAL" IMAGE IN HIGH AMBIENT WITH MEDIUM BACKLIGHT
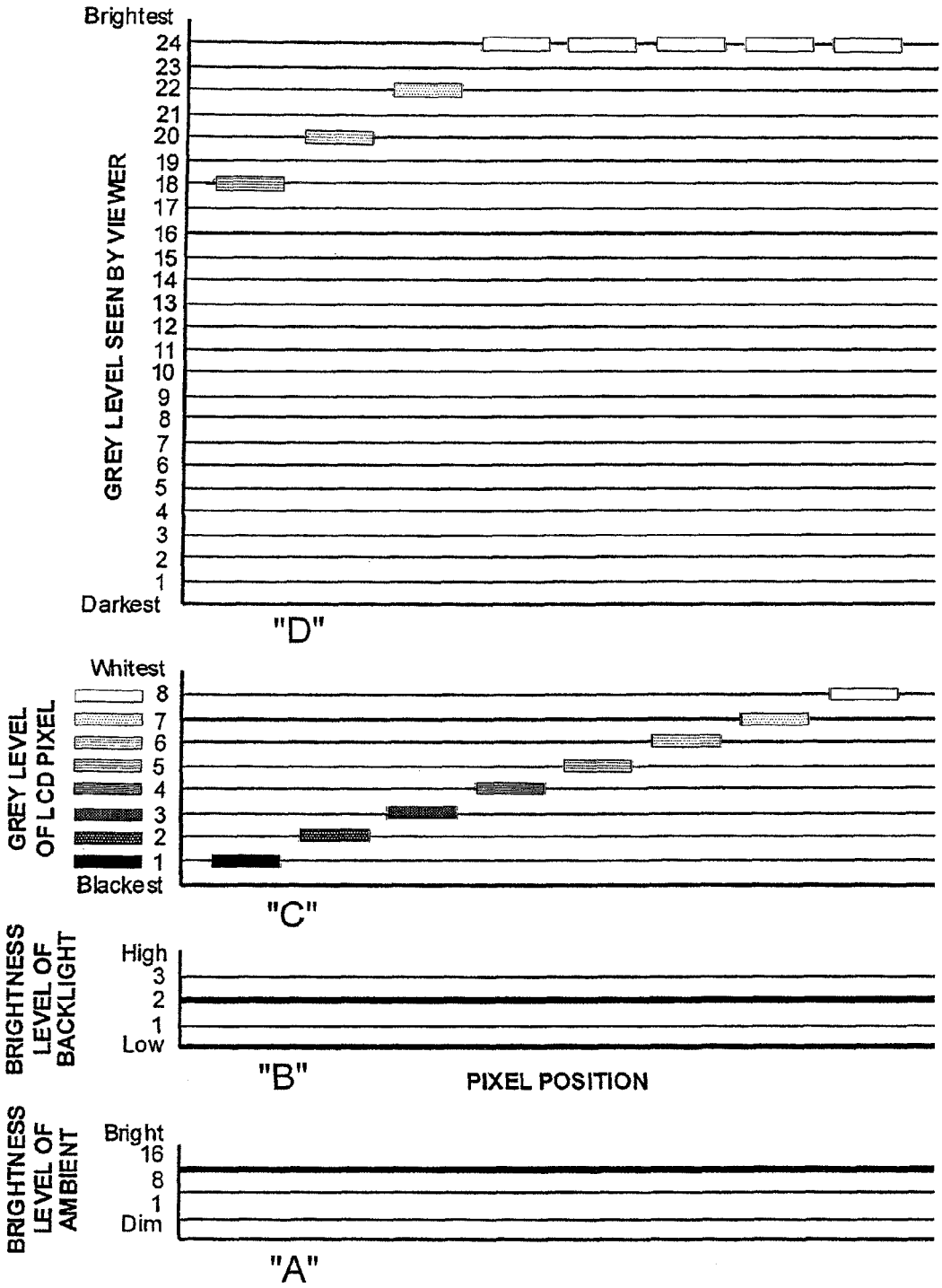

FIGURE #4: "NORMAL" IMAGE IN HIGH AMBIENT WITH MINIMUM BACKLIGHT
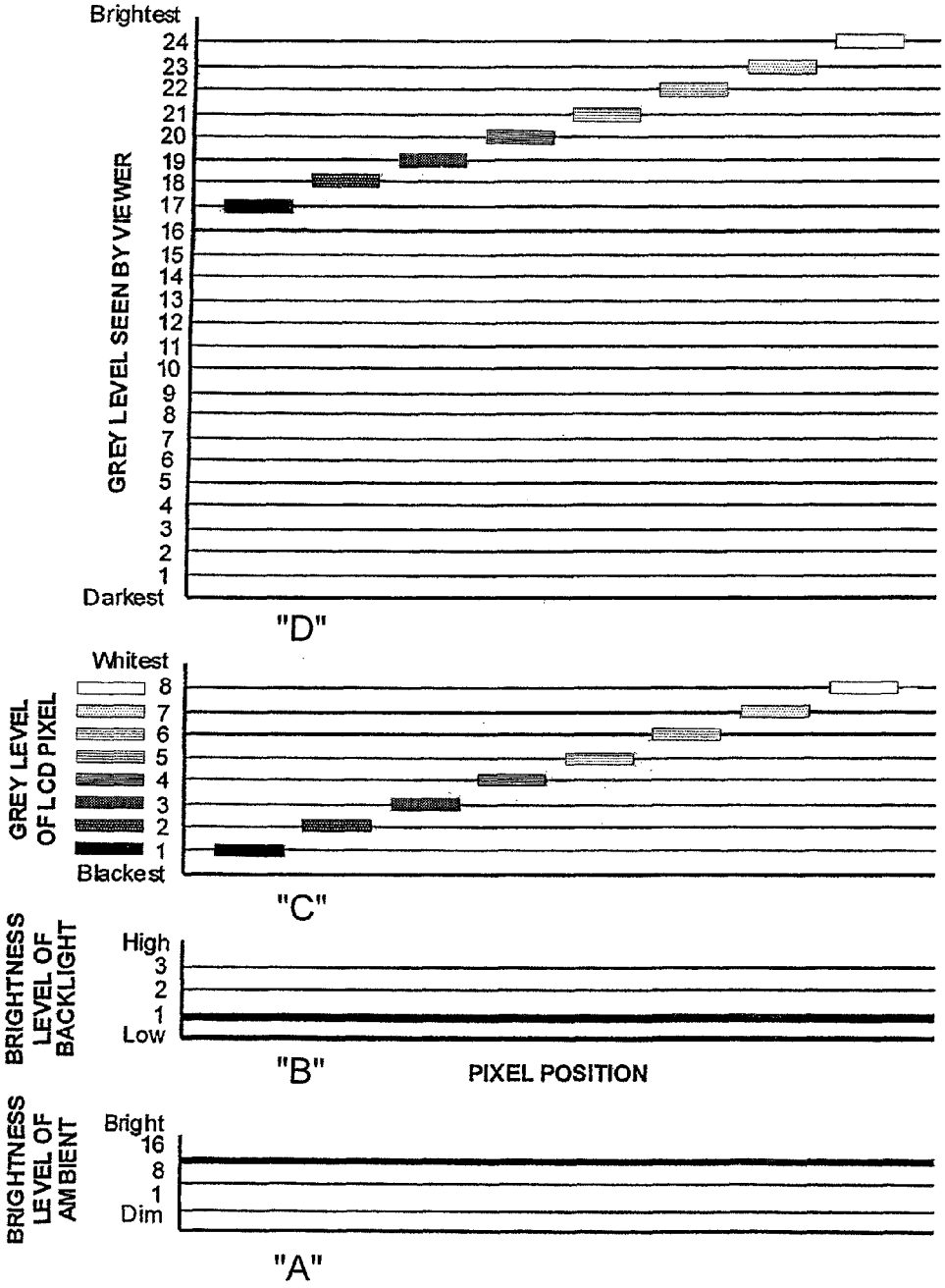

FIGURE #5A: "NORMAL" IMAGE IN HIGH AMBIENT WITH MINIMUM BACKLIGHT AND GREY SCALE ADJUSTMENT
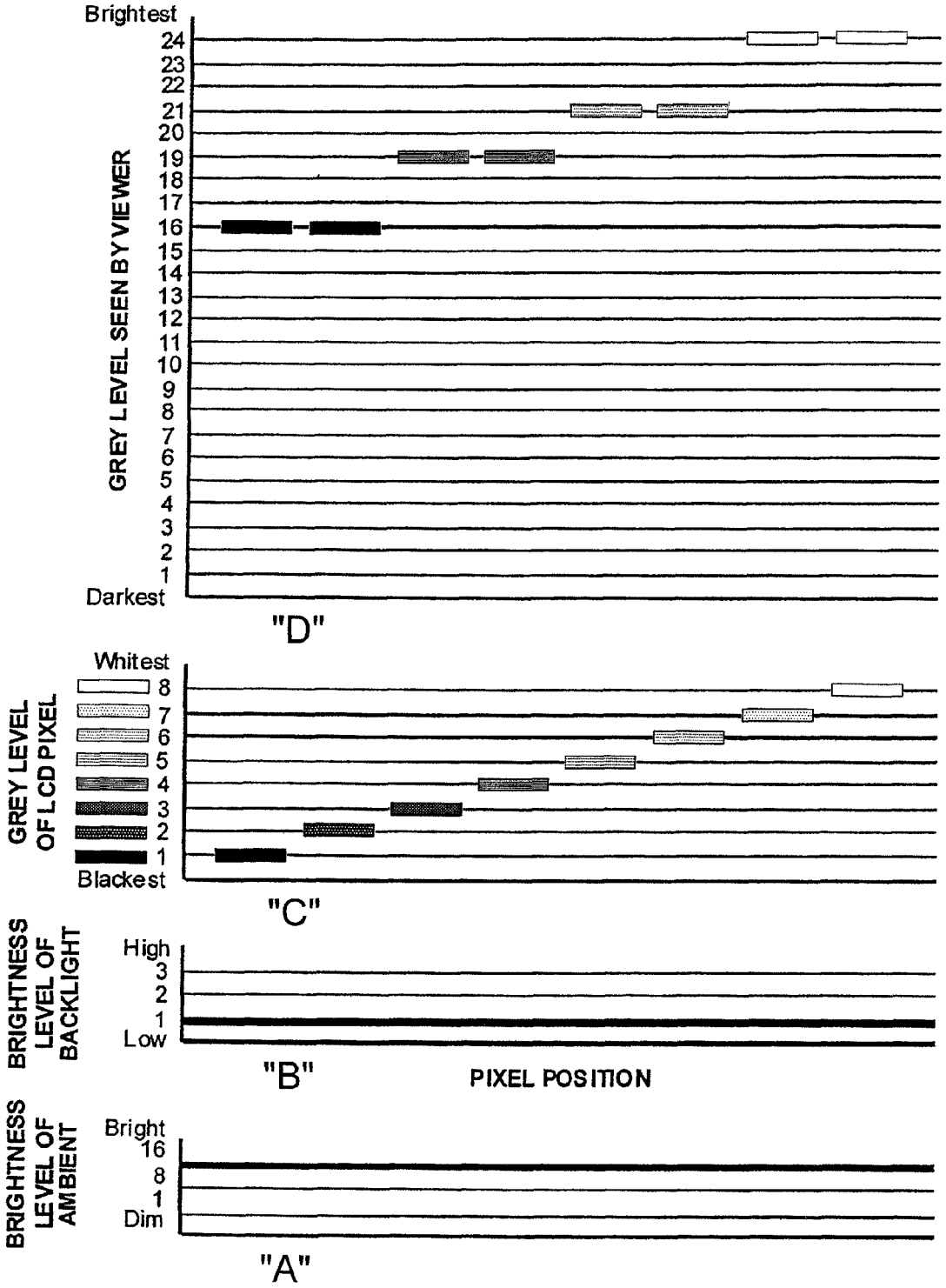

FIGURE #6: "NORMAL" IMAGE IN HIGH AMBIENT WITH MINIMUM BACKLIGHT AND "TEXT" GREY SCALE ADJUSTMENT
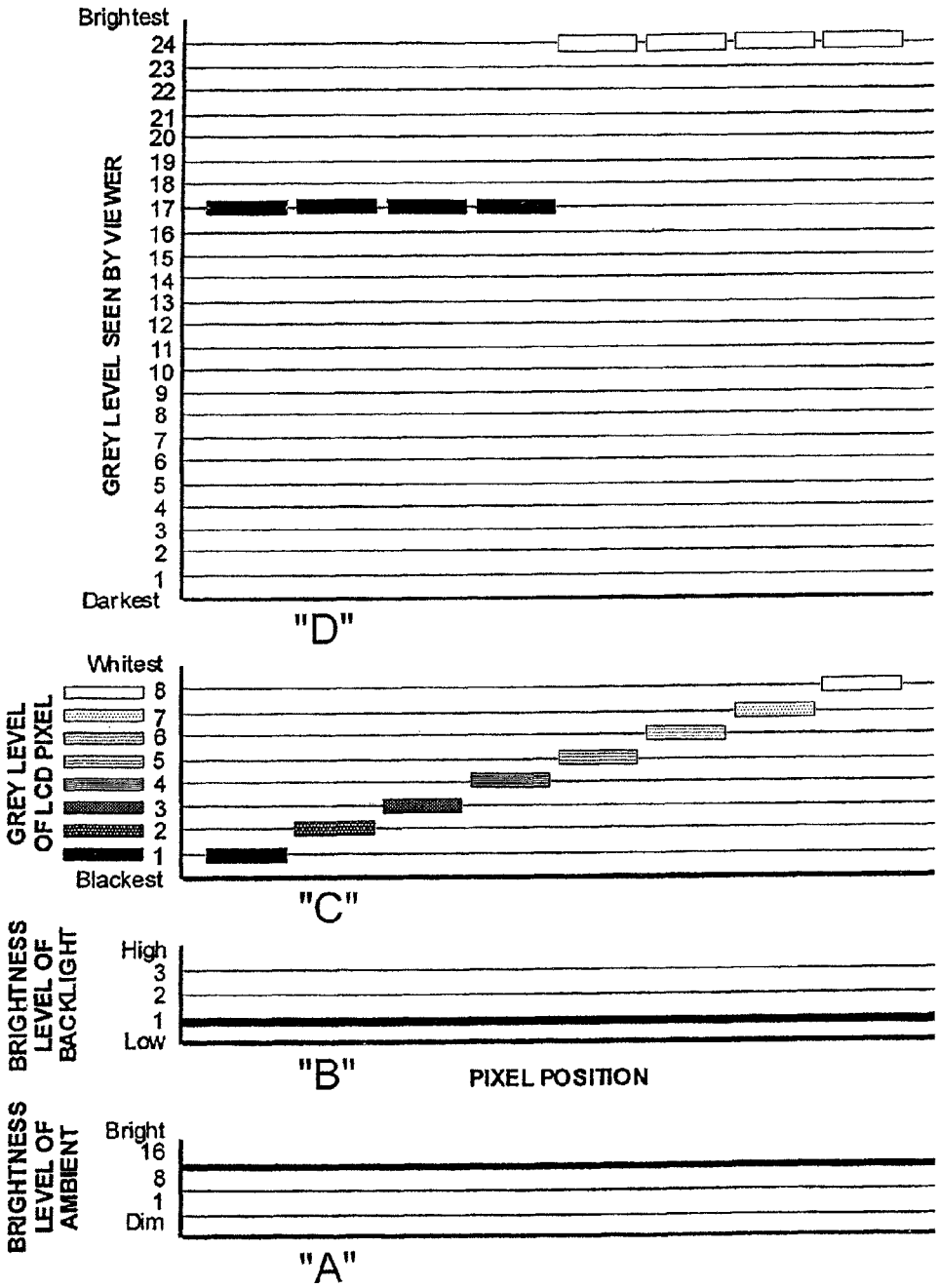

APPARATUS, METHOD AND SYSTEM TO ENHANCE LEGIBILITY OF IMAGES SHOWN ON A PASSIVE DISPLAY IN A BRIGHT ENVIRONMENT BY INCREASING OR MAINTAINING A RANGE OF GREY LEVELS AND DECREASING A NUMBER OF GREY LEVELS IN THAT RANGE

REFERENCE TO PROVISIONAL APPLICATION

This application claims priority from U.S. provisional patent application No. 61/356,837, filed Jun. 21, 2010, the entire disclosure of which hereby is incorporated by this reference.

TECHNICAL FIELD

This invention relates to the display technology, and, more particularly, as indicated, to apparatus and method to enhance legibility of images shown on a display.

BACKGROUND

Passive displays, e.g., liquid crystal displays, digital micromirror device (DMD) displays, electrochromic displays, and so forth, typically modulate light that is provided from a light source, e.g., from a backlight, edge light, ambient light or some other light source. The description below is presented with respect to liquid crystal displays (sometimes referred to as LCD or as LCDs), although it will be appreciated that the description may apply similarly to other passive displays.

A problem encountered by passive displays occurs in bright ambient lighting conditions, which may make it difficult to interpret the image presented on a passive display. It may be difficult to "make out," to understand, or to see details in an image that is shown on a passive display under bright ambient lighting conditions. The bright ambient light may be from bright sunlight, a brightly lit room or some other condition or environment in which there is bright light condition. This problem may occur without regard to the device or system in which the passive display is used; examples include portable computers, e.g., laptop, notebook and hand-size computers, portable digital assistants, mobile telephones, and hand-held games.

As only one example, the problem of reduced legibility in bright ambient light conditions may be due to reduced contrast between relatively bright portions and relatively dark portions of an image being shown on the display. Some prior devices address this issue by including an ambient light sensor or a user control that enables an increase in the brightness of the display when the ambient light level is high. This approach suffers from several limitations. One of those limitations is that quite often the light source, such as, for example, LEDs (light emitting diodes) or other light source, already is operating at maximum brightness and it is not possible to further increase their light output (sometimes referred to as brightness or intensity). Another limitation is that if increasing the brightness is possible, doing so actually may produce only a small increase in the legibility or contrast ratio of the image. This can be explained by the following example.

In the context of this example we make the following definitions.

A liquid crystal display (LCD) includes a backlight and a liquid crystal modulator. The backlight is a light source that illuminates the liquid crystal modulator. The liquid crystal modulator includes a number of pixel areas (sometimes, referred to as pixels) that can be operated to control light transmission through the respective pixels to create an image, for example.

Ambient lighting uniformly illuminates all pixels in the display. In the example here, for simplicity the brightness of the ambient is described as Low (level 1), Intermediate (level 8) or High (level 16). The Low level might correspond, for example, to typical office lighting conditions. The Intermediate level might correspond to indirect outdoor lighting. The High level might correspond to direct sunlight.

The backlight uniformly illuminates all pixels in the display. The brightness of the backlight is described as Minimum (level 1), Medium (level 2) or Maximum (level 3). The backlight described herein is one or more light emitting diodes (LEDs), but it will be appreciated that other types of light sources may be used and the it also will be appreciated that such illumination may be provided from a direction other than from the back or behind the liquid crystal modulator, e.g., from a side.

The LCD pixels can produce eight (8) shades of grey. Level 1 is the Blackest and level 8 is the Whitest. The use of grey levels in creating an image is, of course, known in the display art. The reference herein to the term "grey level," "grey shade" and "shade of grey" may be used to mean the same; these terms are known in the art, as is mentioned elsewhere herein.

The "Grey Level Seen by the Viewer" applies to each pixel individually and is equal to the product of the (Grey Level of that pixel)×(the brightness of the backlight)+(the brightness level of the ambient). Values of the pixel Grey level seen by the viewer are described as between Darkest and Brightest.

Using these definitions, consider first an LCD that is presenting a "Normal" image. A "Normal" image occurs when the LCD utilizes all (or at least many) of the available shades of grey and the backlight level is Medium. Further, assume that the "Normal" image is viewed under Low ambient lighting conditions. This situation is illustrated in FIG. 1, which is briefly described just below.

FIG. 1 includes several portions A, B, C and D. FIG. 1, portion A is a graph illustrating the brightness level of ambient light from level 1 (dimmest) to level 16 (brightest); in the example represented by FIG. 1, portion A the brightness level of ambient light is shown as being at level 1. FIG. 1, portion B is the brightness level of the backlight used to illuminate the pixels of the liquid crystal modulator of the LCD; level 1 is the lowest brightness (dimmest), and level 3 is the highest brightness (brightest); in the example represented by FIG. 1, portion B the brightness level of the backlight is shown as being at level 2. FIG. 1, portion C is a graph representing grey level of eight exemplary respective pixels of the LCD; the grey levels range from level 1 (the blackest or darkest) to level 8 (the whitest or brightest) represented on the Y axis; eight respective pixels are shown spaced along the X axis representing the grey level of those respective pixels from grey level 1 through grey level 8. FIG. 1, portion D is a graph representing grey level seen by a viewer looking at the LCD, the respective grey level values being shown on the Y axis extending from seen grey level 1 (the darkest) to seen grey level 24 (the brightest); eight respective pixels are shown spaced along the X axis representing the grey level seen by a viewer looking at the LCD for eight respective pixels—those seen, grey levels extending from seen grey level 3 through seen grey level 17, as is described further below.

As is shown in FIG. 1, the viewer is presented an image (e.g., represented by the respective pixels in portion D) in which the eight pixels each present a different shade of grey. The shades of grey extend over a range of values from 3 to 17, that is, the range may extend over and utilize up to the 15 different grey levels that are represented in the graph of FIG. 1. The full texture of the image is presented and there is no contouring. The respective shades of grey seen by a viewer are determined by in a sense multiplying the brightness level 2 of the backlight (FIG. 1, portion B) times the grey level of the respective LCD pixel (FIG. 1, portion C, e.g., from grey level 1 to grey level 8, respectively), and ignoring the brightness level of the ambient light as having no impact because it is so low (e.g., shown as level 1 but possibly being at zero or in any event essentially having no impact on the grey level seen by a viewer).

Next, referring to FIG. 2, which is similar to FIG. 1, but here consider the "Normal" image is being viewed under Intermediate ambient lighting conditions, e.g. shown at level 8 in FIG. 2, portion B. As in the case of the example of FIG. 1, the viewer is presented an image in which the eight pixels as seen by a viewer each present a different shade of grey. The shades of grey extend over a range of values from 10 to 24, that is, the range may extend over and utilize up to the 15 different grey levels that are illustrated in the graph. As before, the full texture of the image is presented and there is no contouring. Note, however, that the brightest pixel now corresponds to the upper limit of the display, which is grey level 24 seen by the viewer. In FIG. 2 the respective shades of grey seen by a viewer (portion D) are determined by in a sense multiplying the brightness level 2 of the backlight (FIG. 2, portion B) times the grey level of the respective LCD pixel (FIG. 2, portion C, e.g., from grey level 1 to grey level 8, respectively), and then adding the brightness level of the ambient light, namely a value 8. Thus, for the first pixel to the left in FIG. 2, portion D, the grey level seen by the viewer is [(grey level of LCD pixel, a value of 1, portion C) times (brightness level of backlight, a value of 2, portion B)] plus (brightness level of ambient, a value 8, portion A) equals grey level 10 seen by viewer. Similarly, for the last pixel to the right in FIG. 1, the grey level value of 24 seen by the viewer is obtained by the just-described computation, e.g., [8 (grey level of LCD pixel)×2 (brightness level of backlight)] plus 8 (brightness level of ambient) equals 24.

In FIG. 3, the "Normal" image is viewed under Maximum ambient lighting conditions, e.g., level 16, as shown in portion A. Portions B and C of FIG. 3 are shown the same as in FIGS. 1 and 2. In the example of FIG. 3, as is seen in portion D, the viewer is presented an image in which only 4 grey levels are utilized. Five of the brightest pixels, e.g., as are shown as the five right-most pixels in FIG. 3, portion D, have reached the maximum grey level to be seen by the viewer. The shades of grey seen by a viewer extend from a value of 18 to 24, that is, 7 different levels are utilized. In this case, the full texture of the image is not presented and contouring is likely to occur.

The upper limit is a reflection of the fact that the human vision system has saturated and is not capable of further grey shade discrimination. Also, the upper limit may be a limiting characteristic of the LCD itself. In the drawings of this patent application, the upper limit is represented, for example, by a value number 24.

SUMMARY

An aspect of the invention relates to improving legibility of text images shown on a passive multicolor field sequential display, including providing to the display an image signal representing text as to cause the display to show the text as a black, non-light-transmitting portion or reduced light transmitting portion of the display, and illuminating the display with light provided simultaneously from plural light sources of different respective colors.

A further aspect according to the above includes wherein the passive multicolor field sequential display is configured to operate in a field sequential mode being illuminated sequentially by light of different respective colors, and said illuminating comprises illuminating the display with light provided simultaneously from plural light sources of different respective colors when operating in a text mode and said illuminating further comprises illuminating the display sequentially with light provided respectively from plural light sources of different respective colors.

A further aspect according to the above includes wherein said illuminating with light provided simultaneously comprises illuminating with substantially white light.

A further aspect according to the above includes wherein said illuminating with light provided simultaneously comprises illuminating with substantially red light.

A further aspect according to the above includes providing the image on the display as black on a background of white or red.

Another aspect of the invention relates to a method of improving contrast of images that are provided by a passive display that is capable of modulating incident light over a range of grey levels in response to an image signal, including reducing the number of grey levels at which the light is modulated and increasing the magnitude of brightness difference between respective pairs of adjacent grey levels in the range of grey levels.

A further aspect according to the above includes wherein said reducing and increasing comprises reducing the number of grey levels while substantially maintaining the range, of grey levels.

A further aspect according to the above includes wherein said reducing grey levels comprises combining at least two grey levels.

A further aspect according to the above includes wherein said reducing grey levels comprises combining a pair of grey levels that are relatively adjacent in brightness levels of light provided after modulation by the passive display.

A further aspect according to the above includes wherein said reducing grey levels comprise combining a first pair of grey levels that are relatively adjacent in brightness levels of light provided after modulation by the passive display to obtain one grey level, and combining a second pair of grey levels that are relatively adjacent in brightness levels of light provided after modulation by the passive display to obtain a second grey level different from the one grey level.

A further aspect according to the above includes wherein said combining respective pairs of grey levels comprises combining more than two grey levels.

A further aspect according to the above includes simultaneously illuminating the passive display with light of different colors from respective light sources.

A further aspect according to the above includes wherein said illuminating comprises illuminating the passive display with light of colors that combine to illuminate the display with substantially white light.

A further aspect according to the above includes wherein said illuminating comprises illuminating the display with light from light emitting diodes (LEDs).

A further aspect according to the above includes adjusting the light sources to adjust color.

A further aspect according to the above includes the reducing the number of grey levels including reducing the number of grey levels to two grey levels, respectively, at or near the ends of the range of grey levels.

Another aspect of the invention relates to a display device for displaying an image represented by an input image signal having a first number of grey levels, the display device including a liquid crystal display panel; a backlight; and a control operatively coupled to the liquid crystal display panel and the backlight, wherein the control is configured to receive the input image signal including a number of grey levels and data indicative of ambient brightness, and, if the ambient brightness is above a predetermined threshold, the control is configured to adjust intensity of the backlight while adjusting transmission of the liquid crystal display panel to reduce the first number of grey levels to a second number of grey levels.

A further aspect according to the above includes a brightness detection unit configured to detect brightness of ambient light and provide data indicative of ambient brightness to the control.

A further aspect according to the above includes wherein the control is configured to adjust the intensity of the backlight by reducing the intensity of the backlight.

A further aspect according to the above includes wherein the input image signal includes a first number of grey levels within a given range, and the control is configured to reduce the number of grey levels while maintaining the given range of grey levels.

Another aspect of the invention relates to a method of displaying an image on a display apparatus in a bright ambient environment, the display apparatus including a backlight, a passive display panel and a control, the image being represented by an input image signal having a first number of grey levels, the method including adjusting intensity of the backlight while adjusting transmission of the passive display panel to reduce the first number of grey levels to a second number of grey levels; and displaying the image using the adjusted backlight intensity and the modified number of grey levels.

A further aspect according to the above includes wherein adjusting intensity of the backlight includes reducing the intensity of the backlight.

A further aspect according to the above includes wherein the input image signal includes a first number of grey levels within a given range, the method comprising reducing the number of grey levels while maintaining the given range of grey levels.

Another aspect of the invention relates to a control system for a field sequential multicolor display system, including a converter configured to convert a multicolor image signal to a monochromatic image signal to cause a display to show a monochromatic image, and a light control configured to operate different color sources of light of the multicolor display system to illuminate the display simultaneously with plural colors of light while the display is being operated to show a monochromatic image.

A further aspect according to the above includes wherein the field sequential multicolor display system includes a display and an illuminating system including the multiple sources of light that illuminates the display sequentially with different respective colors of light in coordination with a sequence of fields representing respective color components of a multicolor image that are shown on the display.

A further aspect according to the above includes a selector to select operation of the display system in field sequential multicolor mode to present multicolor images or in monochromatic mode to display images in black and either white or another color.

A further aspect according to the above includes wherein the another color is red.

Another aspect of the invention includes a passive display, an illuminating system operable to illuminate the display with light of respective colors, a controller operable in response to input signals to provide input image signals to the display to show respective images while illuminated by light provided by the illuminating system, the controller being adapted to provide to the display input image signals representing a sequence of image fields of respective color components of a multicolor image in coordinated relation with the illuminating system providing light of the color of respective color components, the controller including a converter adapted to convert multicolor input signals to monochromatic input signals, and a selector adapted to select operation of the controller to provide to the display input image signals representing a sequence of image fields of respective color components of a multicolor image in coordinated relation with the illuminating system providing light of the color of respective color components or to provide to the display monochromatic input image signals while the illuminating system is providing light multiple colors to the display.

Another aspect of the invention relates to a method of operating a field sequential multicolor display, including converting a signal representing a multicolor image to a signal representing a monochrome image, and illuminating the display simultaneously with light of different colors.

A further aspect according to the above includes the converting including converting respective images representing respective color components of a multicolor image for presentation in sequential fields by the display to a monochromatic image.

Another aspect of the invention relates to a method of increasing legibility of a color sequential display system that is operable to provide multicolor images and includes a display to present an image and sources of light of different respective colors to illuminate the display, including converting a multicolor image into a monochromatic image for presenting on the display, and illuminating the display simultaneously with light of different colors from a plurality of the sources of light.

Another aspect of the invention relates to a method of displaying an image on a passive display in an environment in which there is ambient light, wherein the passive display has a capability of modulating light from a display light source over a predetermined range of grey shade levels to provide a range and number of grey shade levels seen by a viewer of the passive display, including when the intensity of ambient light incident on the passive display is increased, reducing the intensity of light incident on the passive display by the display light source, maintaining a relatively wide range and relatively reduced number of grey shade levels provided by the passive display as illuminated by the display light source thereby to provide a relatively wide range of grey levels seen by a viewer of the passive display, and reducing the number of grey shade levels seen by the viewer.

Another aspect of the invention relates to a display system, including a display light source, a passive display capable of modulating incident light from the display light source over a range of grey shade levels to provide grey shade levels in forming an image for viewing by a viewer, a controller operable to improve legibility of the image when the intensity of ambient light incident on the passive display is increased by reducing intensity of incident light from the display light source while maintaining a relatively wide range and reduced number of grey shade levels forming an image for viewing by a viewer.

Another aspect of the invention relates to a method of displaying images provided by an LCD capable of operation in color sequential mode using a plurality of light sources of different colors, including concurrently illuminating the LCD by a plurality of light sources of different colors while combining as one image images represented by the colors of said plurality of light sources of different colors.

A further aspect according to the above includes wherein the concurrently illuminating includes illuminating the LCD using red, green and blue light.

A further aspect according to the above includes wherein the concurrently illuminating comprising illuminating the LCD with a combination of light of different colors that combine to provide illumination by white light.

A further aspect according to the above includes adjusting tint of the white light.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed.

Although the invention is shown and described with respect to certain preferred embodiments, it is obvious that equivalents and modifications will occur to others skilled in the art upon the reading and understanding of the specification. The present invention includes all such equivalents and modifications, and is limited only by the scope of the claims. Many aspects of the invention can be better understood with reference to the following drawings.

Also, although the various features are described and are illustrated in respective drawings/embodiments, it will be appreciated that features of a given drawing or embodiment may be used in one or more other drawings or embodiments of the invention.

It should be emphasized that the term "comprise/comprising" when used in this specification is taken to specify the presence of stated features, integers, steps or components but does not preclude the presence or addition of one or more other features, integers, steps, components or groups thereof."

BRIEF DESCRIPTION OF THE DRAWINGS

In the annexed drawings:

FIGS. 1-3 are exemplary graphical representations of the above-described examples of the operation of an LCD, respectively, in FIG. 1 "normal" image in dim ambient light with a medium backlight, FIG. 2 "normal" image in intermediate ambient with medium backlight, FIG. 3 "normal" image in high ambient with medium backlight, FIG. 4 is an exemplary graphical representation of a "normal" image in high ambient with minimum backlight;

FIG. 5A is an exemplary graphical representation of a "normal" image in high ambient with minimum backlight and grey scale adjustment;

FIG. 6 is an exemplary graphical representation of a "normal" image in high ambient with minimum backlight and "text" grey scale adjustment.

DESCRIPTION

Figure 5B:
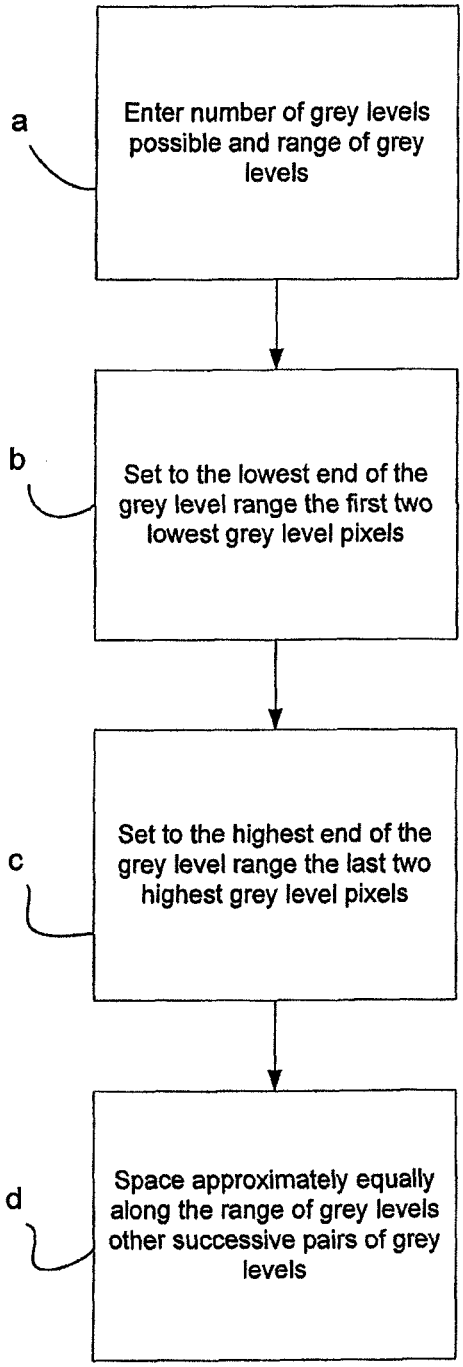
FIG. 5B is a schematic logic or computer program flow chart diagram representing exemplary steps carried out in accordance with a method described with respect to FIG. 5A.

Briefly, an aspect of the invention relates to a solution to the problem of reduced or poor image legibility of a passive display, e.g., an LCD, when viewed under bright ambient lighting conditions.

In FIG. 4 is illustrated an example of a method for improving legibility of images viewed on an LCD in bright ambient light conditions. The "Normal" image is viewed under maximum ambient conditions, as is represented in portion A of FIG. 4, where the brightness level of ambient light is shown at level 16 (bright). However, as is represented in portion B of FIG. 4, the brightness level of the backlight illumination has been reduced to Minimum (level 1 as illustrated). Considering the equation discussed above with respect to FIG. 2, the result is that the viewer is presented with an image in which of the eight pixels shown in portion D (the graph showing grey level seen by viewer) each presents a different shade of grey. These levels are still at the brighter end of the display's capability.

The condition represented in the example of FIG. 4 is, therefore, an improvement over the condition represented in the example of FIG. 3. However, the shades of grey in FIG. 4 extend from a value of 17 to 24, that is, 8 levels. That means that the 8 grey levels as can be seen by a viewer as is represented in portion D in FIG. 4 are closer together than the 8 levels seen by a viewer in portions D in Figures #1 and #2.

Although the condition represented by the example in FIG. 4 is an improvement on that presented in FIG. 3, it is still not as good as those represented in FIG. 1 or 2. The image presented in FIG. 4 will still present an image with less texture and the potential for contouring that the images presented by the representation in FIGS. 1 and 2.

The increase in number of grey shades used from 4 in FIGS. 3 to 8 in FIG. 4 is experimentally found to not improve legibility. The reason is that in bright images, human vision has reduced ability to discriminate grey shades and cannot effectively tell the difference between a bright image composed of 4 grey levels as opposed to one with 8 grey level. Therefore, even with the above-described adjustment to the backlight, the legibility of the "Normal" image is reduced under Maximum ambient lighting conditions.

Reference is made to FIG. 5A. At portion A, the graph representing brightness level of ambient shows ambient bright, e.g., at level 17. At portion B the relevant graph shows the brightness level of the backlight low, e.g., at level 1. At portion C the grey level of LCD pixel for eight pixels at different respective levels show a range of grey level from level 1 (blackest) to level 8 (whitest). These conditions in FIG. 5A, portions A and C are similar to those described above with respect to the illustrations in the corresponding portions of FIGS. 3 and 4. Compared to FIG. 3, portion B, though, in FIG. 5A the level of the backlight has been reduced.

As shown in FIG. 5A, though, not only has the level of the backlight been reduced to Minimum (as seen in portion B), but also the grey shades of the LCD have been adjusted; and this adjustment is illustrated in the graph of FIG. 5A, portion D, which shows the grey levels seen by a viewer, as is described further below. The nature of the adjustment is a "mapping" of the grey shades such that their range has been maintained, e.g., as is shown in portion D extending between level 17 to level 24, but their number has been reduced, e.g., to four levels shown, respectively, at levels 17, 19, 21 and 24. Stated another way, in FIG. 5A, the range still extends from a value of 17 to 24, that is, 8 levels, but only 4 grey shade levels are used rather than the 8 levels in the example of FIG. 4.

Reducing the number of grey levels utilized from 8 to 4 while maintaining the brightness range of the levels does reduce the texture of the image shown on the LCD and does increase the potential for contouring. In that regard, the example of FIG. 5A is not an improvement over the example of FIG. 4. On the other hand, the condition in the example of FIG. 5A has experimentally been found to provide increase image legibility as compared to the condition in FIG. 4.

Various techniques may be used to perform the mentioned mapping of the grey shades such that their range is maintained, but their number has been reduced. One example of such mapping is represented by the FIG. 5A portions C and D. In portion C 8 grey levels are shown, but in portion D only 4 grey levels are shown, e.g., levels 17, 19, 21 and 24. By reducing the number of grey levels contrast or brightness between grey levels may be increased and, thus, may increase legibility of an image viewed by a viewer on the LCD.

The following algorithm, which is schematically illustrated in FIG. 5B may represent an example of the mentioned mapping, as follows (the steps a through d described below are represented by the same alphabet letters a through d in FIG. 5B):

a. Knowing that the grey level of LCD pixel possibilities in portion C extends in a given range of levels and number of levels, in the example it is a range of 8 levels, divide the total number of levels in half, e.g., down to 4 levels.

b. Set the original first two pixel levels, e.g., those shown in portion C at levels 1 and 2 to be only at the lowest level of the range, e.g., level 1, and make the grey level seen by the viewer for those two pixels (originally levels 1 and 2 in portion C) to be the lowest level as seen by viewer, e.g., level 17, as is illustrated in portion D.

c. Set the original last two pixel levels, e.g., those shown in portion C at levels 7 and 8 to be only at the highest level of the range, e.g., level 8, and make the grey level seen by the viewer for those two pixels (originally levels 7 and 8 in portion C) to be the highest level seen by viewer, e.g., level 24, as is illustrated in portion D.

d. Make the other respective succeeding pairs of grey levels of LCD, e.g., in this example two succeeding pairs of levels 3 and 4 and levels 5 and 6, single respective grey levels that are approximately equally spaced apart in the graph of portion C; and make the grey level seen by the viewer for those respective pairs of pixels between the darkest and brightest grey levels in the utilized range, e.g., respectively level 19 and level 21,in approximately equally spaced apart relation to each other and in the interval between the darkest level 17 and the brightest level 24, as is seen in portion D of FIG. 5A.

Other mapping techniques may currently exist or come into existence in the future and may be used in the invention.

There is a limiting case in the reduction of the number of grey shades. That limiting case is two grey levels, as illustrated in FIG. 6. In this case, the Grey Levels of the LCD Pixels in the image are reduced to full blackest or full whitest. This is particularly useful when the image is text since there is no subtle shading in a text only image. The reduction in the number of grey shades serves to maximize the legibility of the text.

Looking at FIG. 6, there are portions A, B and C, which are shown as the same or similar to corresponding portions in FIG. 5A. However, to obtain the two grey levels in FIG. 6 a mapping may be used. For example, the mapping may take the darkest half of the pixels, e.g., those at grey levels 1 through 4 in portion C of FIG. 6 and make them the lowest (darkest, blackest or dimmest) of the grey levels seen by viewer in portion D, e.g., grey level 17, as is shown; and take the brightest half of the pixels and make them the highest (brightest or whitest) of the grey levels seen by viewer in portion D, e.g., grey level 24, as is shown.

In many instances the "Normal" image is actually in full color and utilizes grey levels of red, green and blue. The above description is applicable both to monochromatic images, e.g., black and white images, and to multicolor images.

The invention may be applied on a color by color basis such that the reduction of number of grey levels while maintaining the range of grey levels may be adjusted for each color. Also, an accommodation may be made for the fact that as the number of grey levels of one color is changed, that may change the overall color of the final image. Thus, additional color adjustments may be made to maintain the desired color of the image seen by a viewer. This adjustment may be analogous to gamma adjustments or to some other adjustments made for color images.

In some cases, the image is composed so as to include areas in which there are subtle variations in color. As part of the grey level reduction process described above, legibility of the image can be improved by reducing the number of grey levels in such a way so as to also reduce the number of colors utilized in the image. As an example, an object in which the color transitions from red to yellow to green over a short distance can be made more legible by eliminating the yellow and transitioning directly from red to green. Although this method is exemplified by eliminating the yellow color, it will be appreciated that a different color may be eliminated instead of yellow. For example, if color in the "Normal" image is provided by the use of three different color light sources, e.g., by red, green and blue light sources or by some other arrangement and/or combination of light sources, one of the light sources may be turned off to eliminate that color. As still another example, all light sources may be used to provide color by a single or by a combination of color outputs from two or more light sources, but still a color formed by such a combination may be eliminated from the output. Thus, for example, a purple color may be formed by an addition of red and blue; the color purple could be eliminated from the output. It will be appreciated that other individual or combination color could be eliminated generally in the manner described or in some other manner to improve legibility of the displayed image on an LCD.

Field Sequential Color Images

There are a number of approaches that can be used to produce a full color image on a LCD. One such approach is called color or field sequential. In the color sequential approach, the most common source of illumination is red, green and blue LEDs (light emitting diodes). As an example of the color sequential approach: first the red content of the image is displayed on the LCD and the red LED is turned on and the green and blue LEDs are turned off. Then the green content of the image is displayed on the LCD and the green LED is turned on and the red and blue LEDs are turned off. Finally the blue content of the image is displayed on the LCD and the blue LED is turned on and the red and green LEDs are turned off. The color "fields" are sequenced sufficiently fast that the images are integrated by the eye of the viewer into a single, full color image. Although LEDs are mentioned here, other light sources may be used.

Part of the reason that a color sequential approach is desirable in a LCD for a portable electronic device is that it is a means to reduce power consumption. This occurs because red/green/blue LED illumination reduces the need for colored filters in the LCD. This, in turn, increases the transmission by a minimum of 3×. (This, for example, as compared to a white LED that produces equal amount of red, green and blue light in its white output, but two of those colors are filtered out or blocked and only the remaining color is transmitted to be modulated to create an image by the LCD.) It follows that with such greatly increased transmission, lower illumination is required to achieve the same brightness, hence, less power consumption.

As is mentioned above, an unfavorable characteristic of a LCD is that the legibility of its image decreases in bright ambient lighting. Some LCD devices address this issue by including an ambient light sensor or a user control that enables an increase in the brightness of the display when the ambient light level is high. Although this approach does work, it suffers from several limitations, as are described below.

First, quite often the LEDs are already operating at maximum brightness and it is not possible to further increase their output. Second, if increasing the brightness is possible, doing so actually produces only a small increase in the legibility or contrast ratio of the image. This can be explained by use of the following example.

Example A:

Let the LCD consist of pixels that can produce 8 shades of grey. Let level 1 correspond to a pixel that is fully black and level 8 correspond to a pixel that is fully white. Exemplary grey levels are illustrated and described with respect to the several drawing figures discussed above, such as in the drawing portions C of FIGS. 1 through 6.

Let the LED backlight be capable of producing 3 levels of illumination. Let the minimum illumination level be designated level 1 and the maximum illumination level be designated as level 10. In this example, the red, green and the blue LEDs can each individually produce an illumination level of between 1 and 10.

The brightness of a pixel=(shade of grey of the pixel)× (illumination level of the backlight).

In the absence of ambient lighting, the contrast ratio of the LCD=(brightness of the whitest pixel)/(brightness of the blackest pixel).

Let the ambient light condition be described by one of three levels. Let the brightness of the lowest ambient light condition be designated as level 1 and the brightness of the highest ambient light condition be designated as level 10.

The presence of ambient light adds equally to the brightness of both the blackest and the whitest pixels.

In the presence of ambient light, the contrast ratio=(brightness of the whitest pixel+ambient light level)/(brightness of the blackest pixel+ambient light level).

Example A':

The following is an example of applying some numbers to the above-described example:

Let the whitest pixel have the highest grey shade, level 8

Let the blackest pixel have the lowest grey shade, level 1

Let the illumination of the backlight be a mid range, level 5

Let the ambient light condition be the lowest, level 1

The contrast ratio of the LCD under this set of conditions is as follows:

$$CR=(8\times5+1)/(1\times5+1)=6.8$$

What happens if the ambient light condition is increased to level 10 is, as follows:

$$CR=(8\times5+10)/(1\times5+10)=3.33$$

Therefore, it can be understood that the contrast has dropped dramatically.

In an effort to address this situation, let the backlight be increased to the maximum, level 10.

$$CR=(8\times10+10)/(1\times10+10)=4.50$$

This is somewhat of an improvement. However, the contrast ratio remains less and the image legibility poorer when the LCD is viewed in the bright ambient light condition.

In accordance with an aspect of the invention, an approach to improve the legibility of the image for a field sequential operating LCD when viewed under bright ambient light conditions.

Accordingly, the color sequential presentation of the display is stopped. The red, green and blue LEDs are all turned on at the same time (or if other three or more color light sources are used to provide color, several or all may be turned on—in the interest of brevity the example here is presented for an illumination system that uses red, green and blue light sources, whether LED type or other type). We note that with the red, green and blue LEDs all on at the same time, the LCD is illuminated with white light and then would not display a colored image. Therefore, in conjunction with switching all 3 LEDs to steady on, the image presented on the LCD is converted into a black and white image. Various techniques are known for converting a color image to a black and white image.

With all three LEDs on, the following description concerns the contrast ratio.

While still in the highest ambient lighting condition, let the red, green and blue LEDs be all turned on at the same time, each individually producing an illumination level of 10. The contrast ratio of the LCD under these conditions is as follows:

$$CR=(8\times(10+10+10)+10)/(1\times(10+10+10)+10)=6.25$$

Note that the values 8 and 1 in the above equation represent the brightest (e.g., whitest) and darkest (e.g., blackest) grey levels provided as grey level of LCD pixels, e.g., as represented in portions C in the several drawing FIGS. 1-6 described above.

This represents a significant increase in the contrast ratio and image legibility.

The contrast ratios obtained in this example are a product of the values used for the parameters and do not necessarily correspond to any reality. However, they do illustrate the trend for improving contrast rations and, thus, provide an exemplary illustration of the invention.

In addition, as was described above, the legibility of the image can be further increased by reducing the number of grey shades used in the composition of the image. The limiting case is to reduce the number of grey shades to 2 for a fully black and white image. Such a case is suitable for the display of text.

Further, with regard to color and the intensity or brightness of the red, green and blue LEDs, when all three LEDs are turned on to the maximum brightness, the brightness of the display will be maximized. Since the intensity or brightness of the light output by the three respective LEDs differs and the response of the human eye varies with color, the color of the full on illumination may not be a desirable white. However, it is possible to have all three LEDs on but to adjust their brightness such that a desirable white is obtained. This would reduce the brightness of the display by some amount, but still may lead to an improvement in legibility as described above.

Backlight Color Change:

In some instances it has been found desirable for a display to show information, e.g., text or other image, on a color field that is other than white or black. For example, in many displays text is shown as black characters on a white background field or as white characters on a dark background, e.g., black or dark grey background. In some aircraft instruments that use LCD devices to display information, the background field may be red or a shade of red and another color so as to avoid negatively affecting the dark adaptation of a viewer's eyes when in a darkened environment, such as in a an aircraft cockpit at night. Similarly, red or other color may be used as a background field in a display for use in special environments, such as, for example, at night, in a dark environment, and so on The several aspects of the invention as are described above may be used in such displays with red or other color background.

In the embodiment described here, a multicolor image is changed to a black and white image, as was described above, and only the red LED would be turned on. The text, for example, is shown in black, but the backlight illumination for the background field on which the text is shown is changed to red or other desired color (depending on which color backlight LED is turned on).

Figure 7:
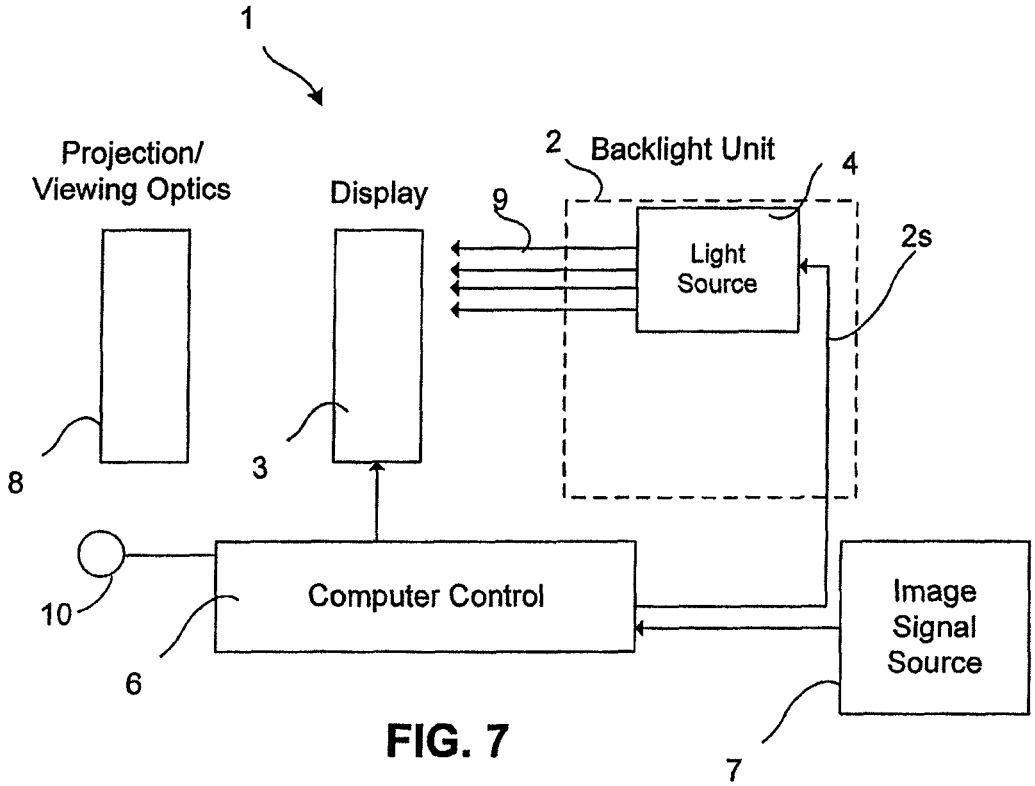
FIG. 7 is a schematic diagram of a display system configured to use features of the present invention.

FIG. 7, illustrates a display system 1, including a backlight unit (BLU) 2 for use with a passive display 3. In the description herein for brevity the passive display may be referred to as LCD or as display, but it will be appreciated that the invention may apply to other passive displays.

The BLU 2 is a light source for a color display (sometimes referred to as a multicolor display) and accordingly includes red, green and blue LEDs (collectively shown at 4). Each of the LEDs may be individually controlled. The display system 1 also includes a controller 6, image signal source or a connection or coupling to such a source, e.g., wired, wireless or otherwise (collectively image signal source 7), and, if needed, viewing optics 8. The controller 6, for example, a computer control, processor, microprocessor, etc., operates the display 3 and the BLU 2 in response to image signals or the like received from the image signal source 7 to provide via the display an image for direct viewing and/or for projection via projection/viewing optics 8. The computer control 6 may be coupled to the respective LEDs of the BLU by signal control line 2*s*. Light 9 from the BLU 2 illuminates (e.g., is incident on) the passive display 3 to form an image that may be viewed by direct view, viewing via viewing optics and/or projected.

A sensor 10 may detect the brightness of ambient light in which the display system 10 or at least the display 3 is located. Thus, the sensor 10, for example, may provide an output signal or other output indicative of a bright ambient light condition. The output from the sensor 10 may be provided the controller, which in turn may operate the display system to improve legibility of the image provided on the display 3, for example, as was described above.

The display (sometimes referred to as a display panel or simply as panel) 3 may be a liquid crystal display (LCD), such as, for example, a twisted nematic liquid crystal cell, a variable birefringence liquid crystal cell, a supertwist liquid crystal cell, or some other type or display able to modulate light. The display 3 may include polarizers, wave plates, such as quarter wave plates or other wave plates, means for compensating for residual birefringence or for problems encountered during off axis viewing, etc. The display 3 may be transmissive, reflective or transflective. Other types of display devices which modulate light as a function of some type of control input can be used in place of the display 3. One skilled in the art will readily appreciate that display 3 may be a LCD or another display, such as, flat panel display, digital micromirror device (DMD) display or other display.

In operation of the display system 1 (sometimes referred to as a display device) the controller 6 provides image signals to the LCD 3. The image signals are received by the controller 6 from an image signal source 7. In response to the image signals, the LCD forms an image. The BLU 2 illuminates the LCD 3 so the image can be seen, e.g., shown on or by the display.

The controller 6 may include an associated memory, input/output connections, operating software or instructions, and so on The operating software may be stored in the memory, for example. The operating software may carry out the functions and methods described above in accordance with the embodiments and aspects of the invention. For example, the controller 6 may adjust grey levels, map grey levels, etc. as was described above.

The controller 6 may be a control operatively coupled to the liquid crystal display panel and the backlight; the control is configured to receive the input image signal including a number of grey levels and data indicative of ambient brightness, and, if the ambient brightness is above a predetermined threshold, the control is configured to adjust intensity of the backlight while adjusting transmission of the liquid crystal display panel to reduce the first number of grey levels to a second number of grey levels. As is mentioned above a brightness detection unit may be used to detect brightness of ambient light and provide information, data or the like indicative of ambient brightness to the control. The control may adjust the intensity of the backlight by reducing the intensity of the backlight. The input image signal includes a first number of grey levels within a given range, and the control may be configured to reduce the number of grey levels while maintaining the given range of grey levels.

In using a display system according to the invention, legibility of text images shown on a passive multicolor field sequential display can be improved by providing to the display an image signal representing text as to cause the display to show the text as a black, non-light-transmitting portion or reduced light transmitting portion of the display, and illuminating the display with light provided simultaneously from plural light sources of different respective colors. The passive multicolor field sequential display may be configured to operate in a field sequential mode being illuminated sequentially by light of different respective colors, and the illumination may be provided simultaneously from plural light sources of different respective colors when operating in a text mode. The illuminating also may be by light provided respectively from plural light sources of different respective colors. The illuminating with light may be by using multiple light sources of different colors to provide substantially white light. Alternatively, the illumination may be by light of a given color, e.g., red light. The image may be provided on the display as black on a background of white or red (or some other color).

A method of improving contrast of images that are provided by a passive display that is capable of modulating incident light over a range of grey levels in response to an image signal, may be carried out, for example, using the system and examples described above, including reducing the number of grey levels at which the light is modulated and increasing the magnitude of brightness difference between respective pairs of adjacent grey levels in the range of grey levels. The reducing and increasing may include reducing the number of grey levels while substantially maintaining the range of grey levels.

According to an embodiment, a method of displaying an image on a display apparatus in a bright ambient environment, the display apparatus including a backlight, a passive display panel and a control, and the image being represented by an input image signal having a first number of grey levels, the method includes adjusting intensity of the backlight while adjusting transmission of the passive display panel to reduce the first number of grey levels to a second number of grey levels; and displaying the image using the adjusted backlight intensity and the modified number of grey levels. The adjusting intensity of the backlight may include reducing the intensity of the backlight. The input image signal may include a first number of grey levels within a given range, the method includes reducing the number of grey levels while maintaining the given range of grey levels.

The controller 6 may be the or part of the control system for a field sequential multicolor display system, and may include a converter configured to convert a multicolor image signal to a monochromatic image signal to cause a display to show a monochromatic image, and a light control configured to operate different color sources of light of the multicolor display system to illuminate the display simultaneously with plural colors of light while the display is being operated to show a monochromatic image. The field sequential multicolor display system may include a display and an illuminating system including multiple sources of light that illuminates the display sequentially with different respective colors of light in coordination with a sequence of fields representing respective color components of a multicolor image that are shown on the display. A selector may select operation of the display system in field sequential multicolor mode to present multicolor images or in monochromatic mode to display images in black and either white or another color. e.g., red.

One example of an embodiment includes a method of displaying an image on a passive display in an environment in which there is ambient light, wherein the passive display has a capability of modulating light from a display light source over a predetermined range of grey shade levels to provide a range and number of grey shade levels seen by a viewer of the passive display, including reducing the intensity of light incident on the passive display by the display light source if the ambient light is bright, maintaining a relatively wide range and relatively reduced number of grey shade levels provided by the passive display as illuminated by the display light source thereby to provide a relatively wide range of grey levels seen by a viewer of the passive display, and reducing the number of grey shade levels seen by the viewer.

An embodiment also includes an display system including a display light source, a passive display capable of modulating incident light from the display light source over a range of grey shade levels to provide grey shade levels in forming an image for viewing by a viewer, and a controller operable to improve legibility of the image when the intensity of ambient light incident on the passive display is increased by reducing intensity of incident light from the display light source while maintaining a relatively wide range, and reduced number of grey shade levels forming an image for viewing by a viewer.

Other features, aspects and embodiments are described herein.

It will be appreciated that features, methods and apparatus illustrated and/or described with respect to any of the several figures and/or embodiments herein may be used with features, methods and apparatus illustrated and/or described with respect to other figures and/or embodiments.

It also will be appreciated that portions of the present invention can be implemented in hardware, software, firmware, or a combination thereof. In the described embodiment(s), a number of the steps or methods may be implemented in software or firmware that is stored in a memory and that is executed by a suitable instruction execution system. If implemented in hardware, for example, as in an alternative embodiment, implementation may be with any or a combination of the following technologies, which are all well known in the art: discrete logic circuit(s) having logic gates for implementing logic functions upon data signals, application specific integrated circuit(s) (ASIC) having appropriate combinational logic gates, programmable gate array(s) (PGA), field programmable gate array(s) (FPGA), etc.

Any process or method descriptions or blocks in flow charts may be understood as representing modules, segments, or portions of code which include one or more executable instructions for implementing specific logical functions or steps in the process, and alternate implementations are included within the scope of the preferred embodiment of the present invention in which functions may be executed out of order from that shown or discussed, including substantially concurrently or in reverse order, depending on, the functionality involved, as would be understood by those reasonably skilled in the art of the present invention.

The logic and/or steps represented in the flow diagrams of the drawings, which, for example, may be considered an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The above description and accompanying drawings depict the various features of the invention. It will be appreciated that the appropriate computer code could be prepared by a person who has ordinary skill in the art to carry out the various steps and procedures described above and illustrated in the drawings. It also will be appreciated that the various terminals, computers, servers, networks and the like described above may be virtually any type and that the computer code may be prepared to carry out the invention using such apparatus in accordance with the disclosure hereof.

Specific embodiments of an invention are disclosed herein. One of ordinary skill in the art will readily recognize that the invention may have other applications in other environments. In fact, many embodiments and implementations are possible. The following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

It will be apparent to a person having ordinary skill in the art of computer programming, how to program the display system described herein to operate and carry out logical functions associated with description above. Accordingly, details as to specific programming code have been left out for the sake of brevity. Also, while the functions and may be executed by respective processing devices in accordance with an embodiment, such functionality could also be carried out via dedicated hardware or firmware, or some combination of hardware, firmware and/or software.

Although certain embodiments have been shown and described, it is understood that equivalents and modifications falling within the scope of the appended claims will occur to others who are skilled in the art upon the reading and understanding of this specification.

What is claimed is:

1. A method of improving contrast of images that are provided by a passive display that is capable of modulating incident light over a range of grey levels in response to an image signal, comprising reducing the number of grey levels at which the light is modulated and increasing the magnitude of brightness difference between respective pairs of adjacent grey levels in the range of grey levels, wherein said reducing and increasing comprises adjusting intensity of the backlight while adjusting transmission of the passive display panel to reduce a first number of grey levels to a second number of grey levels while substantially maintaining the range of grey levels.

2. The method of claim 1, wherein said reducing grey levels comprises combining at least two grey levels.

3. The method of claim 1. wherein said reducing grey levels comprise combining a first pair of grey levels that are relatively adjacent in brightness levels of light provided after modulation by the passive display to obtain one grey level, and combining a second pair of grey levels that are relatively adjacent in brightness levels of light provided after modulation by the passive display to obtain a second grey level different from the one grey level.

4. The method of claim 1 comprising simultaneously illuminating the passive display with light of different colors from respective light sources.

5. The method of claim 4, wherein said illuminating comprises illuminating the passive display with light of colors that combine to illuminate the display with substantially white light.

6. The method of claim 1, said reducing the number of grey levels comprising reducing the number of grey levels to two grey levels, respectively, at or near the ends of the range of grey levels.

7. A display device for displaying an image represented by an input image signal having a first number of grey levels, the display device comprising:

a liquid crystal display panel;

a backlight; and a control operatively coupled to the liquid crystal display panel and the backlight, wherein the control is configured to receive the input image signal including, a number of grey levels and data indicative of ambient brightness, and, if the ambient brightness is above a predetermined threshold, the control is configured to adjust intensity of the backlight while adjusting transmission of the liquid crystal display panel to reduce the first number of grey levels to a second number of grey levels, wherein the input image signal includes a first number of grey levels within a given range, and the control is configured to reduce the number of grey levels while maintaining the given range of grey levels over which the passive display is capable of modulating incident light.

8. The display device of claim 7, further comprising:

a brightness detection unit configured to detect brightness of ambient light and provide data indicative of, ambient brightness to the control.

9. The display device of claim 7, wherein the control is configured to adjust the intensity of the backlight by reducing the intensity of the backlight.

10. A method of displaying an image on a display apparatus in a bright ambient environment, the display apparatus including a backlight, a passive display panel and a control, the image being represented by an input image signal having a first number of grey levels within a given range, the method comprising:

adjusting intensity of the backlight while adjusting transmission of the passive display panel to reduce the first number of grey levels to a second number of grey levels while maintaining the given range of grey levels over which the passive display is capable of modulating incident light; and displaying the image using the adjusted backlight intensity and the modified number of grey levels.

11. A method of displaying an image on a passive display in an environment in which there is ambient light, wherein the passive display has a capability of modulating light from a display light source over a predetermined range of grey shade levels to provide a range and number of grey shade levels seen by a viewer of the passive display, comprising when the intensity of ambient light incident on the passive display is increased reducing the intensity of light incident on the passive display by the display light source, maintaining the predetermined range of grey shade levels and relatively reducing a number of grey shade levels provided by the passive display as illuminated by the display light source thereby to provide a relatively wide range of grey levels seen by a viewer of the passive display, and reducing the number of grey shade levels seen by the viewer.

12. A display system, comprising a display light source, a passive display capable of modulating incident light from the display light source over a range of grey shade levels to provide grey shade levels in forming an image for viewing by a viewer, a controller operable to improve legibility of the image when the intensity of ambient light incident on the passive display is increased by reducing intensity of incident light from the display light source while maintaining the range of grey shade levels and reducing a number of grey shade levels in the range of grey shade levels, forming an image for viewing by a viewer.

* * * * *